US008002438B2

(12) United States Patent
Ko

(10) Patent No.: US 8,002,438 B2
(45) Date of Patent: Aug. 23, 2011

(54) ADJUSTABLE LUMINAIRE

(76) Inventor: Hun-Yuan Ko, Taipei County (TW)

( * ) Notice: Subject to any disclaimer, the term of this patent is extended or adjusted under 35 U.S.C. 154(b) by 263 days.

(21) Appl. No.: 12/510,230

(22) Filed: Jul. 27, 2009

(65) Prior Publication Data

US 2011/0019423 A1 Jan. 27, 2011

(51) Int. Cl.
*F21S 4/00* (2006.01)
*F21V 21/00* (2006.01)

(52) U.S. Cl. ..... 362/249.1; 362/249.02; 362/249.03; 362/287; 362/413; 362/427

(58) Field of Classification Search ..... 362/249.02, 362/249.03, 249.04, 249.1, 287, 413, 414, 362/427, 529, 524
See application file for complete search history.

(56) References Cited

U.S. PATENT DOCUMENTS 5,424,931 A * 6/1995 Wheeler ..... 362/427
7,954,980 B2 * 6/2011 Bryant et al. ..... 362/287
2010/0033969 A1 * 2/2010 Hochstein et al. ..... 362/249.03
* cited by examiner

*Primary Examiner* — Stephen F Husar

(57) ABSTRACT

An adjustable luminaire includes a base, a tubular arm movably connected to the base, and a light assembly connected to the tubular arm and simultaneously moved with the movement of the tubular arm. The light assembly has at least two light shades pivoted relative to each other and a plurality of light sources disposed on the at least two light shades. The adjustable luminaire further includes a driving assembly mounted in the tubular arm and the base. The driving assembly movably connected to the light assembly. The driving assembly is simultaneously moved with the movement of the tubular arm to drive the light assembly for adjusting a pivoting angle between the at least two light shades so as to vary an illuminated area which is illuminated by the light sources.

9 Claims, 12 Drawing Sheets

ADJUSTABLE LUMINAIRE

BACKGROUND OF THE INVENTION

1. Field of the Invention

The present invention relates to an adjustable luminaire, and more particularly to a luminaire with adjustable height and illuminated area simultaneously.

2. Description of Related Art

A conventional adjustable luminaire in accordance with the prior art comprises a base, an arm pivoted to the base and carrying a lamp housing at its free end. The adjustable luminaire has a link supporting the arm and being also pivoted to the base and to a member which has a sliding frictional connection with the arm. So that the points at which the arm and the link are pivoted to the base and a connection point of the link and the arm form the apices of a triangle. The adjustable luminaire further comprises a torsion spring which is wound around the axis of a pin on which the link is pivoted to the base. When the arm is held upright, the link has a lost motion connection with the spring. When the link and the arm are swung to take up the lost motion connection, the spring is arranged to apply torque to the link to resist further movement of the link and the arm toward a more horizontal position, and to assist in returning link and arm from such a more horizontal position.

However, the link and the arm only pivotally move relative to the base due to the pin pivotally connecting the arm to the base and the torsion spring pivotally connecting the link to the base. As the lamp housing is moved downwardly or upwardly relative to the base, the illuminated area keeps the same. Therefore, when the lamp is close to the desk, the brightness is relatively high. When the lamp is far away from the desk, the brightness is relatively low. The inappropriate brightness causes a user uncomfortable.

The present invention has arisen to mitigate and/or obviate the disadvantages of the conventional adjustable luminaire.

SUMMARY OF THE INVENTION

The main objective of the present invention is to provide an improved adjustable luminaire.

To achieve the objective, a first embodiment of the adjustable luminaire in accordance with the present invention includes a base, a tubular arm movably connected to the base, and a light assembly connected to the tubular arm and simultaneously moved with the movement of the tubular arm. The tubular arm is inverted L-shaped. The light assembly has at least two light shades respectively pivotally connected to the tubular arm, a plurality of light sources disposed on the at least two light shades for providing uniform illumination, and a pivot rod co-axially disposed in between the two light shades for pivotally connecting the two light shades. The light assembly has an elastomer mounted in between the two light shades. Two ends of the elastomer are connected to the two light shades respectively for tending to pull the two light shades together. The adjustable luminaire further includes a driving assembly mounted in the tubular arm and the base. The driving assembly includes a traction cable having one end connected to the base and the other end connected to a tapered rod. The tapered rod has an enlarged end connected to the traction cable and a narrow end movably abutted against the two light shades. The traction cable and the enlarged end are movably received in the tubular arm.

In accordance with a second aspect of the present invention, the driving assembly includes a gearwheel mounted in the base, a rack movably received in the tubular arm for engaging with the gearwheel, a traction cable having one end connected to the rack, and a tapered rod connected to the other end of the traction cable. The tapered rod has an enlarged end connected to the traction cable and a narrow end movably abutted against the two light shades. The traction cable and the enlarged end are movably received in the tubular arm.

In accordance with a third aspect of the present invention, the driving assembly has two hinge joints disposed on the tubular arm for making the tubular arm foldable. The traction cable is connected to the tapered rod via the two hinge joints.

In accordance with a fourth aspect of the present invention, the elastomer is mounted in between the two light shades. Two ends of the elastomer are abutted against the two light shades respectively for tending to push the two light shades aside. The driving assembly includes a first rack disposed in the base, a first gearwheel disposed in the lower part of the tubular arm for engaging with the first rack, a second gearwheel disposed in the upper part of the tubular arm, a third gearwheel disposed in the tubular arm for engaging with the second gearwheel, a transmission belt disposed between the first gearwheel and the second gearwheel for relatively connecting the first gearwheel and the second gearwheel, and a second rack disposed on the pivot rod for engaging with the third gearwheel. The tubular arm has two limiting rods extending therefrom. The two light shades are disposed in between the two limiting rods and confined by the two limiting rods.

In accordance with a fifth aspect of the present invention, the tubular arm is inverted U-shaped. The end of the tubular arm connected to the base is relatively longer than the other end of the tubular arm. The traction cable is movably received in the tubular arm. The traction cable has one end connected to the base and the other end connected to one side of each of the at least two light shades. The at least two light shades are movably partially received in the tubular arm.

Further benefits and advantages of the present invention will become apparent after a careful reading of the detailed description with appropriate reference to the accompanying drawings.

DETAILED DESCRIPTION OF THE INVENTION

Figure 1:
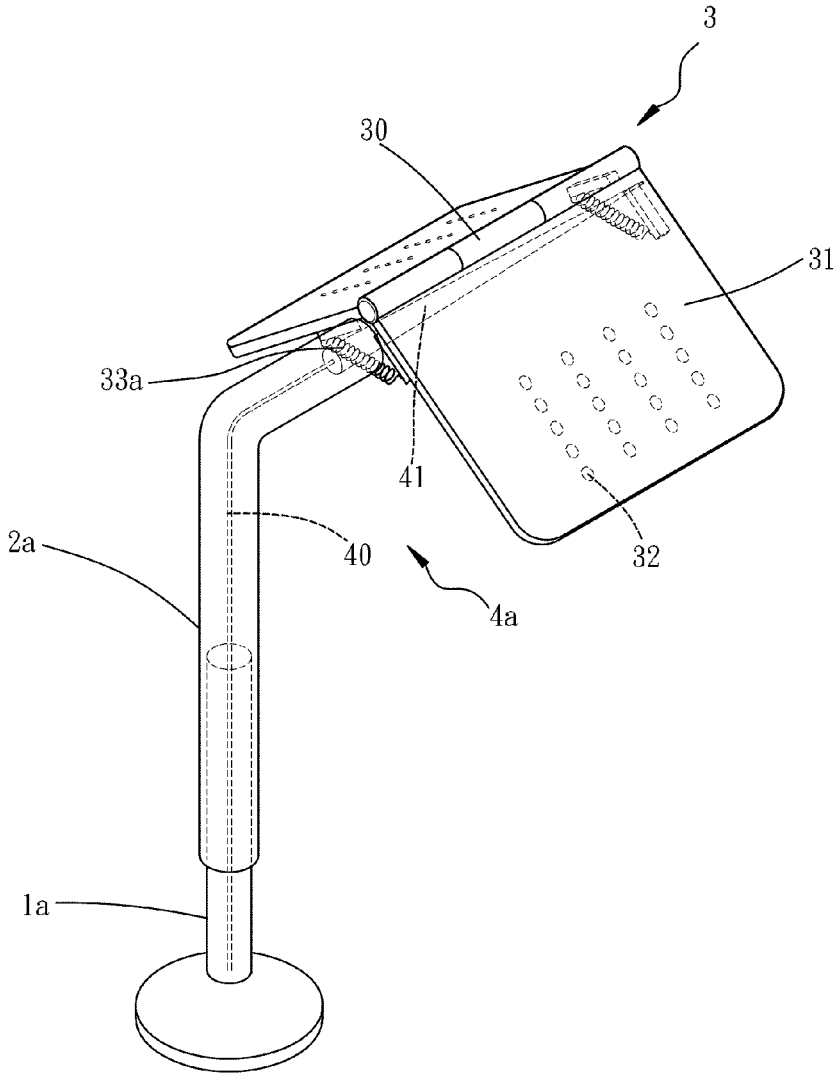
FIG. 1 is an assembled perspective view of a first embodiment of an adjustable luminaire in accordance with the present invention.
Figure 2:
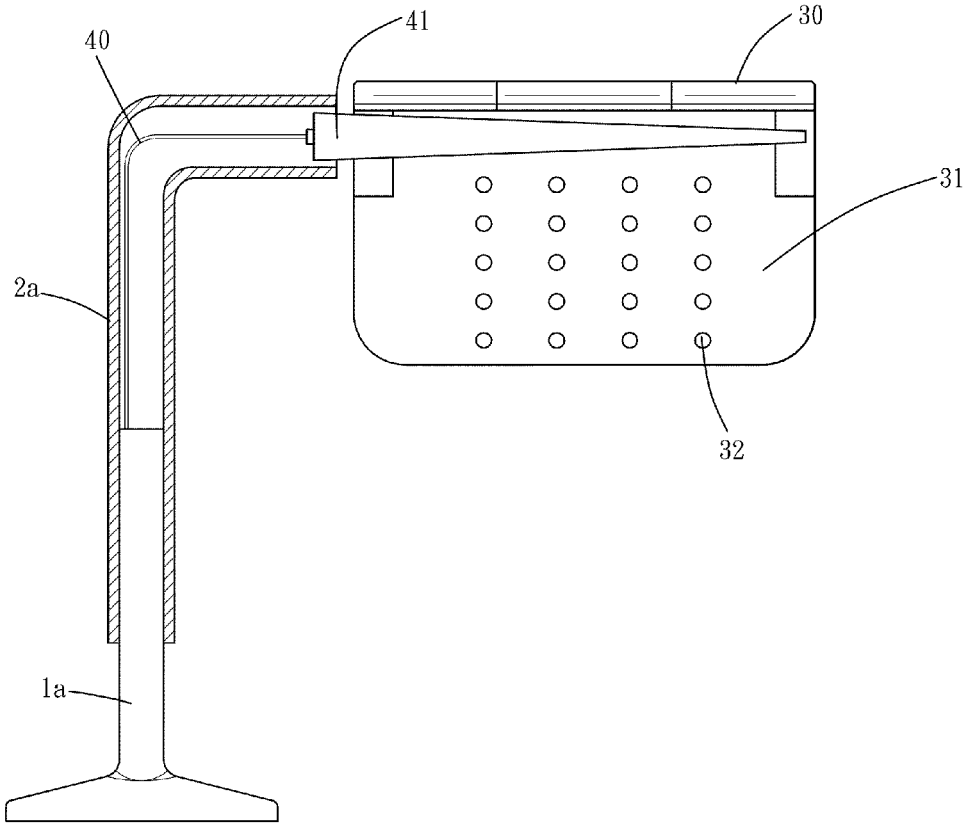
FIGS. 2-3 are operational side views of the first embodiment of the adjustable luminaire in accordance with the present invention as a driving assembly is moved with the movement of the tubular arm.
Figure 3:
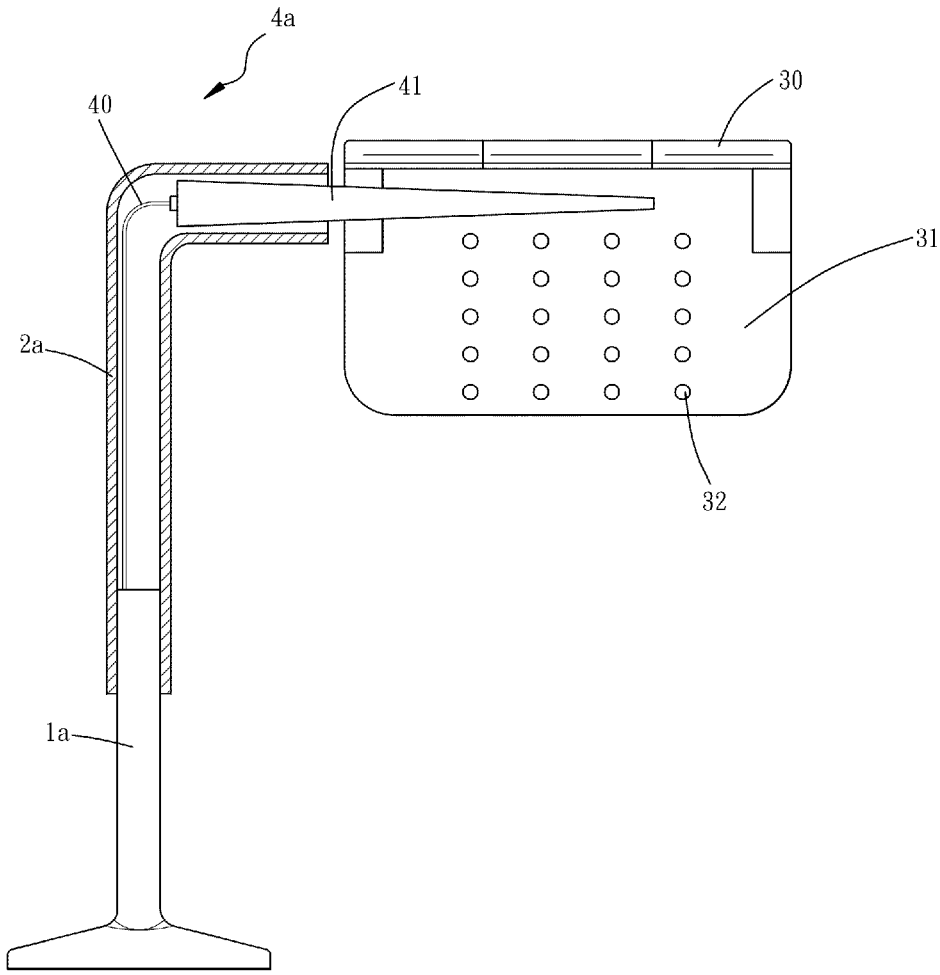
Figure 4:
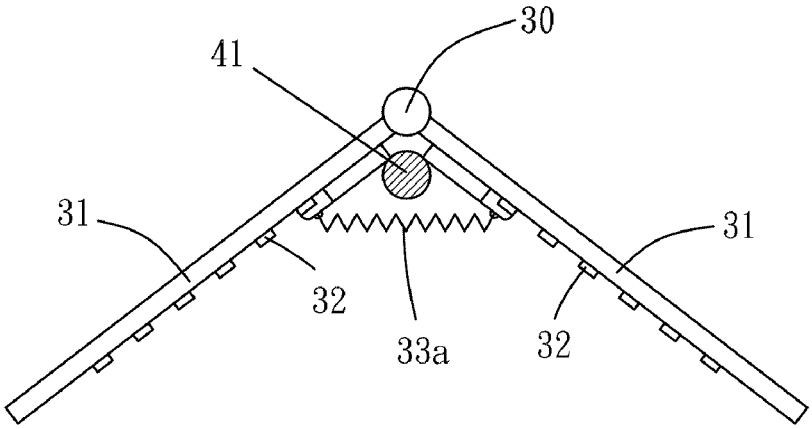
FIG. 4 is a partial cross-sectional view of the first embodiment of the adjustable luminaire in accordance with the present invention as two light shades are unfolded by the tapered rod.
Figure 5:
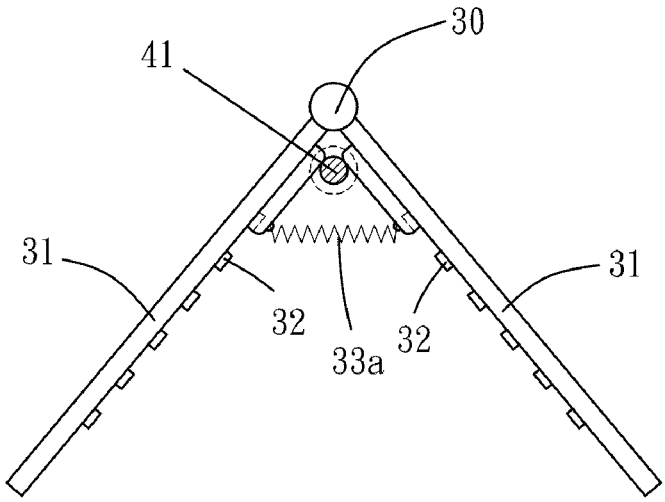
FIG. 5 is a partial cross-sectional view of the first embodiment of the adjustable luminaire in accordance with the present invention as the two light shades are folded by the contractive force of an elastomer.

Referring to the drawings and initially to FIGS. 1-5, a first embodiment of an adjustable luminaire in accordance with the present invention comprises a base (1*a*), a tubular arm (2*a*) having one end movably partially sleeved on the base (1*a*), and a light assembly (3) connected to the other end of the tubular arm (2*a*) and simultaneously moved with the movement of the tubular arm (2*a*). The tubular arm (2*a*) is inverted L-shaped. The light assembly (3) has two light shades (31) respectively pivotally connected to the tubular arm (2*a*), a plurality of light sources (32) disposed on the two light shades (31) for providing uniform illumination, and a pivot rod (30) co-axially disposed in between the two light shades (31) for pivotally connecting the two light shades (31). The two light shades (31) rotate about the pivot rod (30). The light assembly (3) has an elastomer (33*a*) mounted in between the two light shades (31). Two ends of the elastomer (33*a*) are connected to the two light shades (31) respectively to provide a contractive force for tending to pull the two light shades (31) together. The adjustable luminaire further comprises a driving assembly (4*a*) mounted in the tubular arm (2*a*) and the base (1*a*). The driving assembly (4*a*) comprises a traction cable (40) having one end connected to the base (1*a*) and the other end connected to a tapered rod (41) remaining parallel to the two light shades (31). The traction cable (40) is tenacious and bendable to move the tapered rod (41). The tapered rod (41) has an enlarged end connected to the traction cable (40) and a narrow end movably abutted against the two light shades (31). The tapered rod (41) is partially placed between the two light shades (31) and the elastomer (33*a*). The traction cable (40) and the enlarged end are movably received in the tubular arm (2*a*).

Accordingly, when the tubular arm (2*a*) is moved upwardly relative to the base (1*a*), the tapered rod (41) is inwardly pulled by the traction cable (40), such that the two light shades (31) are simultaneously gradually folded by the contractive force of the elastomer (33*a*) for gradually decreasing a pivoting angle between the two light shades (31) to gradually contract an illuminated area which is illuminated by the light sources (32).

When the tubular arm (2*a*) is moved downwardly relative to the base (1*a*), the tapered rod (41) is outwardly pushed by the traction cable (40), such that the two light shades (31) are simultaneously gradually unfolded by a thrust of tapered rod (41) for gradually increasing the pivoting angle between the two light shades (31) to gradually expand the illuminated area which is illuminated by the light sources (32).

Figure 6:
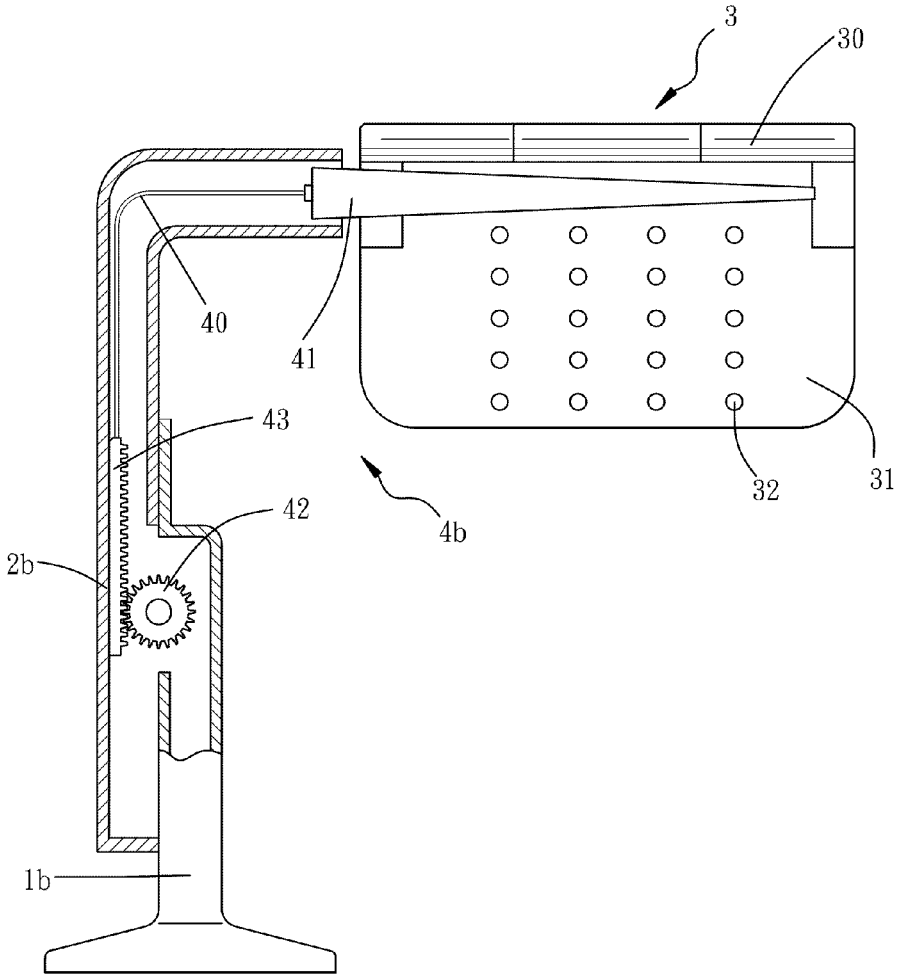
FIGS. 6-7 are operational side views of a second embodiment of the adjustable luminaire in accordance with the present invention as the driving assembly is moved with the movement of the tubular arm.
Figure 7:
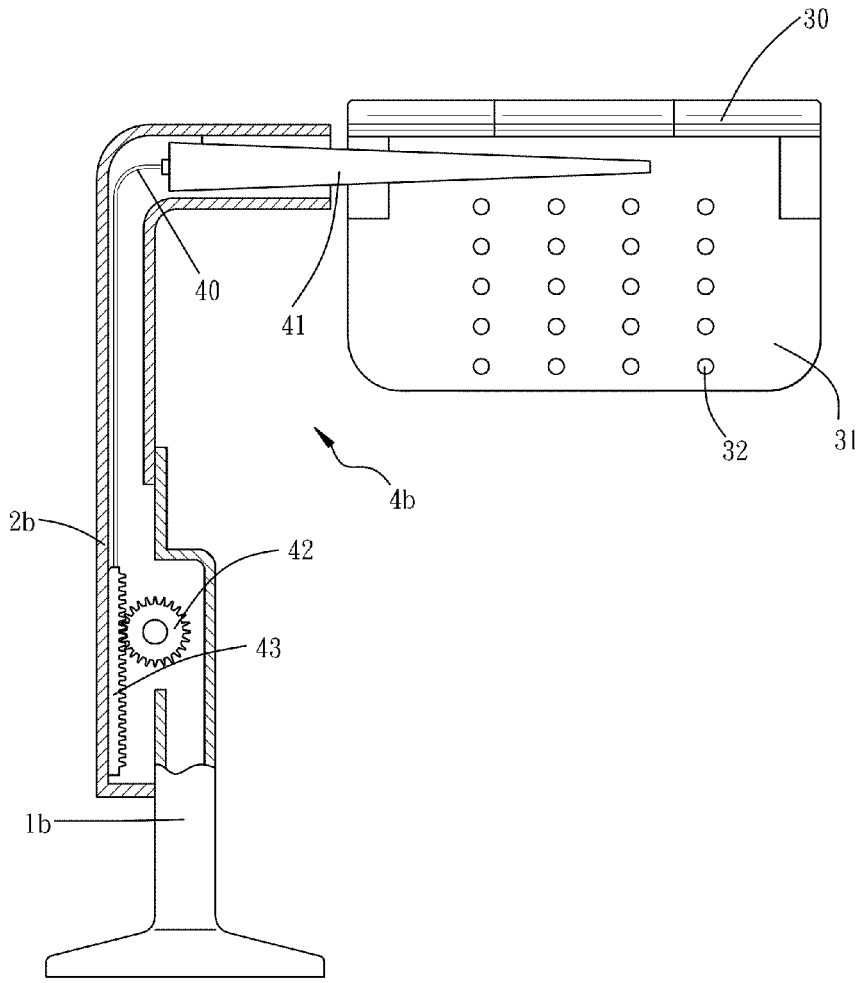

With reference to FIG. 6-7, that shows a second embodiment of the adjustable luminaire in accordance with the present invention. The elements and effects of the second embodiment which are the same with the first embodiment are not described, only the differences are described. In this embodiment, the tubular arm (2*b*) is partially pivotally connected to a lateral side of the base (1*b*). The driving assembly (4*b*) comprises a gearwheel (42) mounted in the base (1*b*), a rack (43) movably received in the tubular arm (2*b*) for engaging with the gearwheel (42). The rack (43) is connected to one end of the traction cable (40). The other end of the traction cable (40) is connected to the enlarged end of the tapered rod (41). The traction cable (40) and the enlarged end are movably received in the tubular arm (2*b*).

Accordingly, when the tubular arm (2*b*) is moved upwardly relative to the base (1*b*), the rack (43) is downwardly engaged by the gearwheel (42). The tapered rod (41) is inwardly pulled by the traction cable (40), such that the two light shades (31) are simultaneously gradually folded by the contractive fore from the elastomer for gradually decreasing the pivoting angle between the two light shades (31) to gradually contract the illuminated area.

When the tubular arm (2*b*) is moved downwardly relative to the base (1*b*), the rack (43) is upwardly engaged by the gearwheel (42). The tapered rod (41) is outwardly pushed by the traction cable (40), such that the two light shades (31) are simultaneously gradually unfolded by the thrust of the tapered rod (41) for gradually increasing the pivoting angle between the two light shades (31) to gradually expand the illuminated area.

Figure 8:
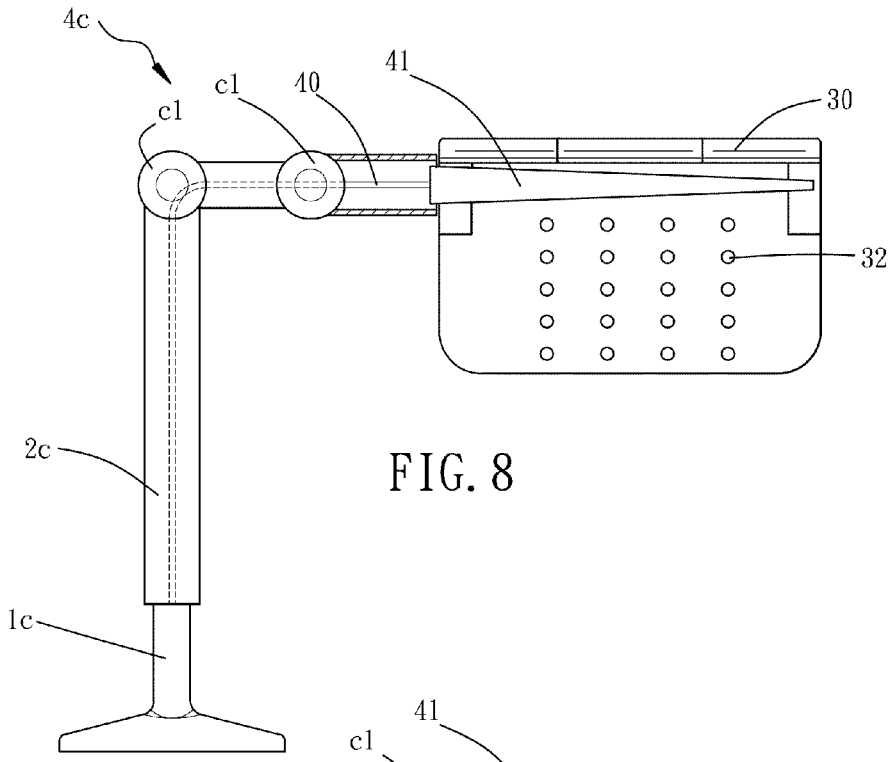
FIGS. 8-9 are operational side views of a third embodiment of the adjustable luminaire in accordance with the present invention as the driving assembly is moved with the movement of the tubular arm.
Figure 9:
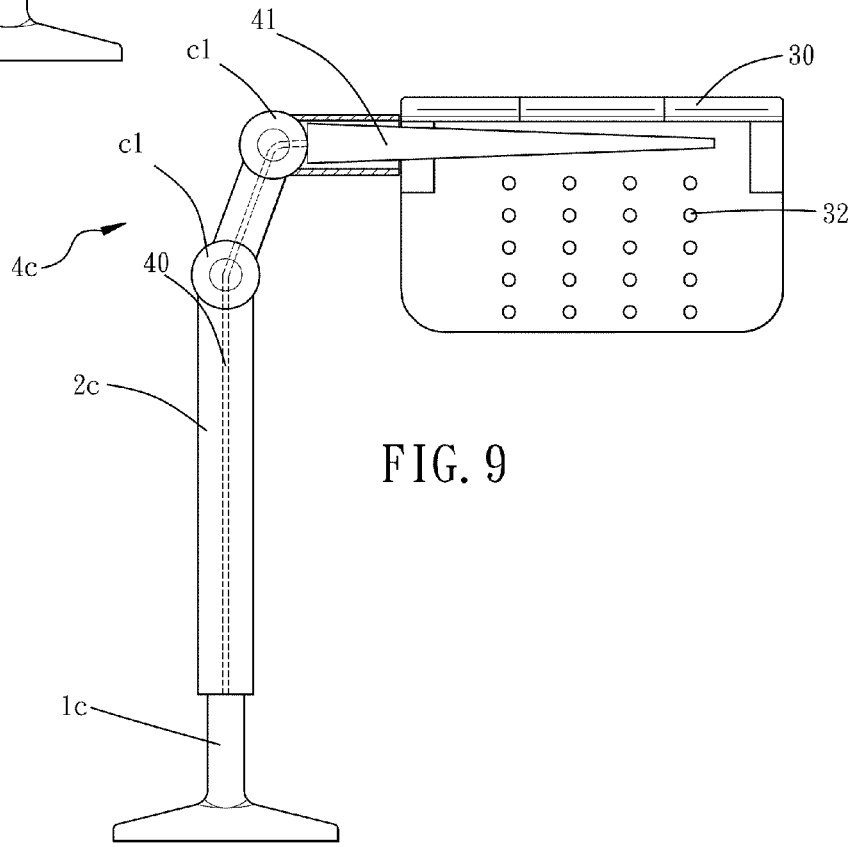
Figure 10:
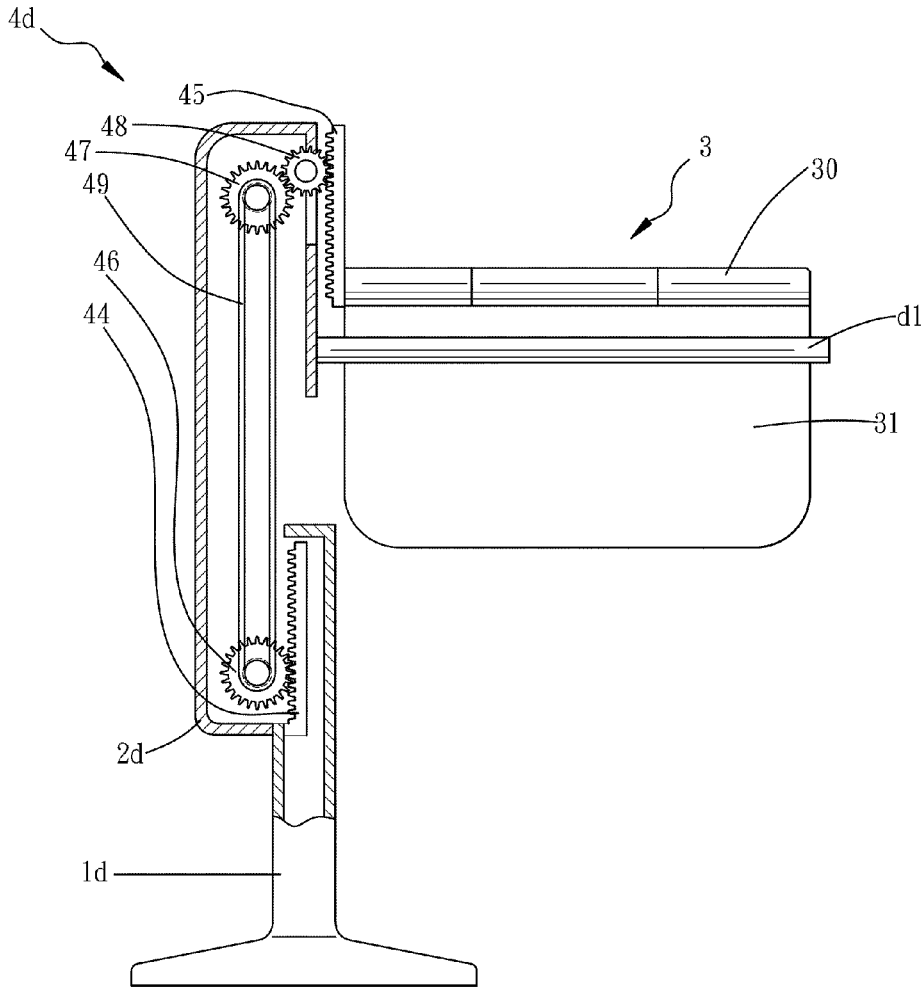
FIGS. 10-11 are operational side views of a fourth embodiment of the adjustable luminaire in accordance with the present invention as the driving assembly is moved with the movement of the tubular arm.
Figure 11:
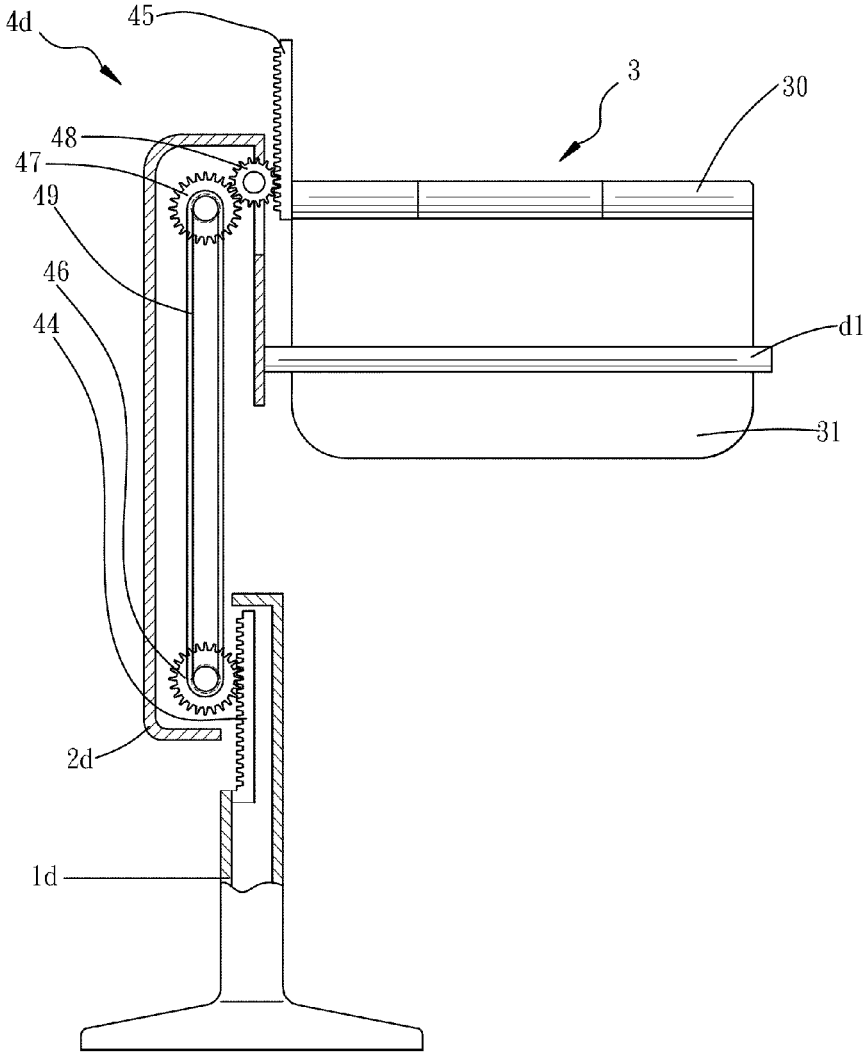
Figure 12:
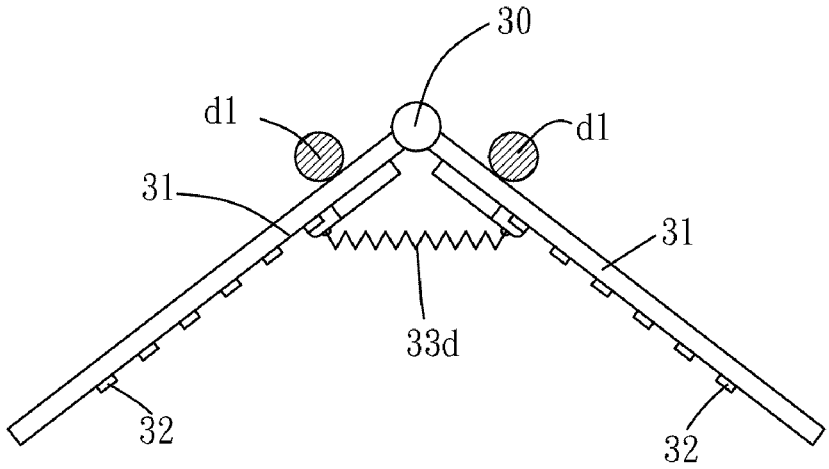
FIG. 12 is a partial cross-sectional view of the fourth embodiment of the adjustable luminaire in accordance with the present invention as the two light shades are unfolded by the expansive force of the elastomer.
Figure 13:
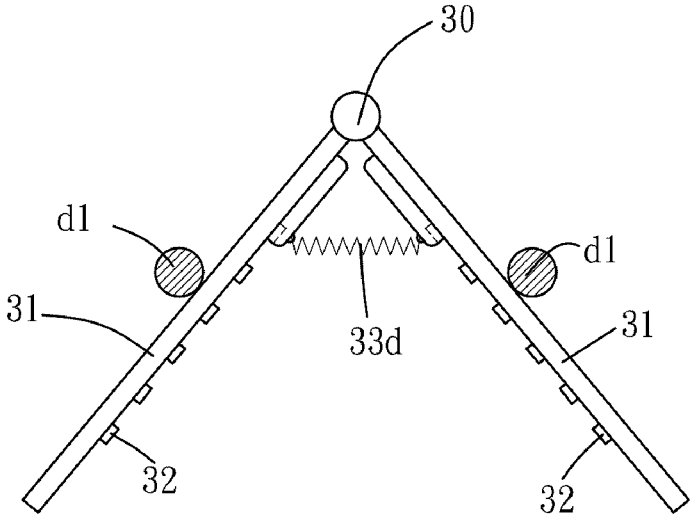
FIG. 13 is a partial cross-sectional view of the fourth embodiment of the adjustable luminaire in accordance with the present invention as the two light shades are folded by the confinement of two limiting rod.

With reference to FIG. 8-9, that shows a third embodiment of the adjustable luminaire in accordance with the present invention. The elements and effects of the third embodiment which are the same with the first embodiment are not described, only the differences are described. In this embodiment, the tubular arm (2*c*) has one end connected to the base (1*c*). The driving assembly (4*c*) has two hinge joints (c1) disposed on the tubular arm (2*c*). The tubular arm (2*c*) is rotatable and foldable about the two hinge joints (c1). The traction cable (40) passes through the two hinge joints (c1) to connect with the tapered rod (41).

Accordingly, when the tubular arm (2*c*) is folded upwardly relative to the base (1*c*), the tapered rod (41) is inwardly pulled by the traction cable (40), such that the two light shades (31) are simultaneously gradually folded by the contractive force from the elastomer for gradually decreasing the pivoting angle between the two light shades (31) to gradually contract the illuminated area.

When the tubular arm (2*c*) is folded downwardly relative to the base (1*c*), the tapered rod (41) is outwardly pushed by the traction cable (40), such that the two light shades (31) are simultaneously gradually unfolded by the thrust of the tapered rod (41) for gradually increasing the pivoting angle between the two light shades (31) to gradually expand the illuminated area.

With reference to FIG. 10-13, that shows a fourth embodiment of the adjustable luminaire in accordance with the present invention. The elements and effects of the fourth embodiment which are the same with the first embodiment are not described, only the differences are described. In this embodiment, the tubular arm (2*d*) is movably and partially connected to the lateral side of the base (1*d*). The elastomer (33*d*) is mounted in between the two light shades (31). Two ends of the elastomer (33*d*) are abutted against the two light shades (31) respectively to provide an expansive force for tending to push the two light shades (31) aside. The driving assembly (4*d*) comprises a first rack (44) disposed in the base (1*d*), a first gearwheel (46) disposed in a lower part of the tubular arm (2*d*) for engaging with the first rack (44), a second gearwheel (47) disposed in an upper part of the tubular arm (2*d*), a third gearwheel (48) disposed in the tubular arm (2*d*) for engaging with the second gearwheel (47), a transmission belt (49) disposed between the first gearwheel (46) and the second gearwheel (47) for relatively connecting the first gearwheel (46) and the second gearwheel (47), and a second rack (45) disposed on one end of the pivot rod (30) for engaging with the third gearwheel (48). The tubular arm (2*d*) has two limiting rods (d1) extending from the lateral side thereof. The two light shades (31) are disposed in between the two limiting rods (d1) and confined by the two limiting rods (d1).

Accordingly, when the tubular arm (2*d*) is moved upwardly relative to the base (1*d*), the first rack (44) is engaged with the first gearwheel (46) for relatively driving the second gearwheel (47) via the transmission belt (49). The third gearwheel (48) is relatively engaged with the second gearwheel (47) for gradually upwardly moving the second rack (45), such that the two light shades (31) are simultaneously gradually upwardly moved and folded by the confinement of the two limiting rods (d1) for gradually contracting the illuminated area.

When the tubular arm (2*d*) is moved downwardly relative to the base (1*d*), the first rack (44) is engaged with the first gearwheel (46) for relatively driving the second gearwheel (47) via the transmission belt (49). The third gearwheel (48) is relatively engaged with the second gearwheel (47) for gradually downwardly moving the second rack (45), such that the two light shades (31) are simultaneously gradually downwardly moved and unfolded by the expansive force from the elastomer (33*d*) for gradually expanding the illuminated area.

Figure 14:
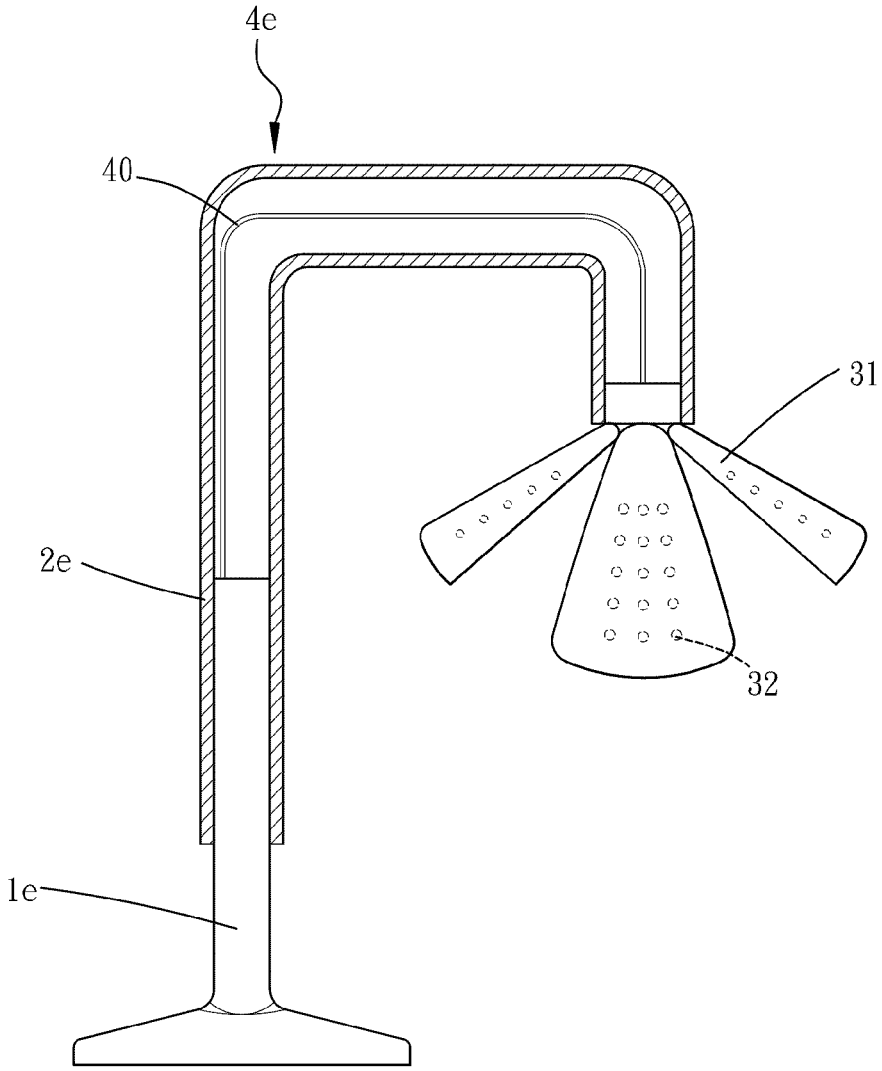
FIGS. 14-15 are operational perspective side views of a fifth embodiment of the adjustable luminaire in accordance with the present invention as the driving assembly is moved with the movement of the tubular arm.
Figure 15:
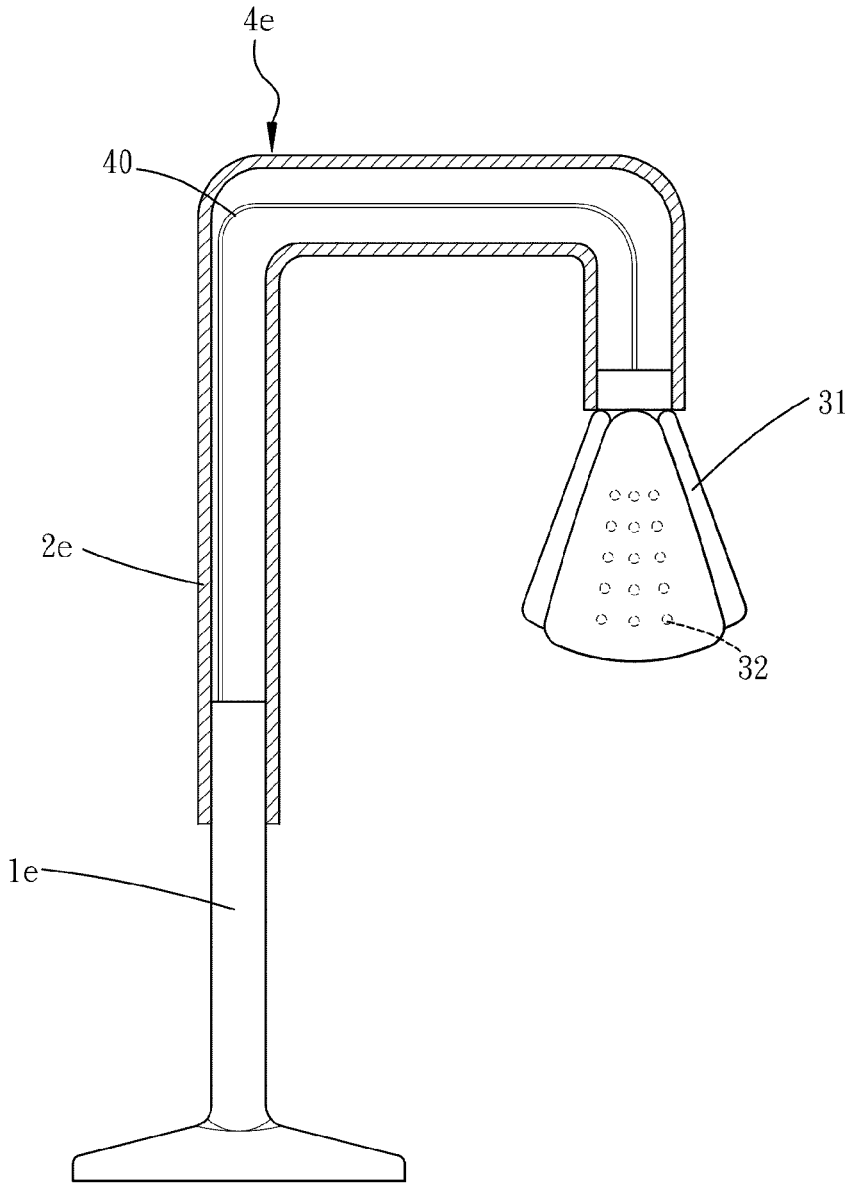

With reference to FIG. 14-15, that shows a fifth embodiment of the adjustable luminaire in accordance with the present invention. The elements and effects of the fifth embodiment which are the same with the first embodiment are not described, only the differences are described. In this embodiment, the tubular arm (2*e*) is inverted U-shaped. One end of the tubular arm (2*e*) is pivotally and partially sleeved on the base (1*e*). The end of the tubular arm (2*e*) connected to the base (1*e*) is relatively longer than the other end of the tubular arm (2*e*). The elastomer (not shown) is mounted in between the at least two light shades (31). The elastomer provides an expansive force for tending to push the at least two light shades (31) aside. The traction cable (40) is movably received in the tubular arm (2*e*). The traction cable (40) has one end connected to the base (1*e*) and the other end connected to one side of each of the at least two light shades (31). The at least two light shades (31) are movably partially received in the tubular arm (2*e*).

Accordingly, when the tubular arm (2*e*) is moved upwardly relative to the base (1*e*), the traction cable (40) gradually pulls up the at least two light shades (31), such that the at least two light shades (31) are simultaneously pivotally folded by the confinement of the tubular arm (2*e*) and partially received in the tubular arm (2*e*) for gradually contracting the illuminated area.

When the tubular arm (2*e*) is moved downwardly relative to the base (1*e*), the traction cable (40) gradually pushes down the at least two light shades (31), such that the at least two light shades (31) are simultaneously pivotally unfolded and extended from the tubular arm (2*e*) by the expansive force of the elastomer for gradually expanding the illuminated area.

Therefore, a user has a comfortable and appropriate illuminated area and brightness as the height of the light assembly (3) is varied.

Although the invention has been explained in relation to its preferred embodiment, it is to be understood that many other possible modifications and variations can be made without departing from the spirit and scope of the invention as hereinafter claimed.

What is claimed is:

1. An adjustable luminaire comprising:

a base;

a tubular arm movably connected to the base;

a light assembly connected to the tubular arm, the light assembly having at least two light shades pivoted relative to each other and a plurality of light sources disposed on the at least two light shades for providing illumination; and a driving assembly mounted in the tubular arm and the base, the driving assembly movably connected to the light assembly, the driving assembly moved with the movement of the tubular arm to drive the light assembly for adjusting a pivoting angle between the at least two light shades so as to vary an illuminated area of the light assembly;

wherein when the tubular arm is moved upwardly relative to the base, the light assembly is driven by the driving assembly such that the pivoting angle between the at least two light shades is relatively changed for gradually contracting the illuminated area; when the tubular arm is moved downwardly relative to the base, the light assembly is driven by the driving assembly such that the pivoting angle between the at least two light shades is relatively changed for gradually expanding the illuminated area.

2. The adjustable luminaire as claimed in claim 1, wherein the at least two light shades are two light shades respectively pivotally connected to the tubular arm, the light assembly having a pivot rod co-axially disposed in between the two light shades for pivotally connecting the two light shades, the light assembly having an elastomer mounted in between the two light shades, two ends of the elastomer connected to the two light shades respectively for tending to pull the two light shades together, the driving assembly comprising a traction cable having one end connected to the base and the other end connected to a tapered rod, the tapered rod having an enlarged end connected to the traction cable and a narrow end movably abutted against the two light shades, the traction cable and the enlarged end movably received in the tubular arm;

wherein when the tubular arm is moved upwardly, the tapered rod is inwardly pulled by the traction cable such that the two light shades are gradually folded by the elastomer for gradually decreasing the pivoting angle between the two light shades to gradually contract the illuminated area;

when the tubular arm is moved downwardly, the tapered rod is outwardly pushed by the traction cable such that the two light shades are gradually unfolded by the tapered rod for gradually increasing the pivoting angle between the two light shades to gradually expand the illuminated area.

3. The adjustable luminaire as claimed in claim 2, wherein the tubular arm is inverted L-shaped.

4. The adjustable luminaire as claimed in claim 1, wherein the at least two light shades are two light shades respectively pivotally connected to the tubular arm, the light assembly having a pivot co-axially disposed in between the two light shades for pivotally connecting the two light shades, the light assembly having an elastomer mounted in between the two light shades, the driving assembly comprising a gearwheel mounted in the base, a rack movably received in the tubular arm for engaging with the gearwheel, a traction cable having one end connected to the rack and a tapered rod connected to the other end of the traction cable, the tapered rod having an enlarged end connected to the traction cable and a narrow end movably abutted against the two light shades, the traction cable and the enlarged end movably received in the tubular arm;

wherein when the tubular arm is moved upwardly, the rack is downwardly engaged with the gearwheel and the tapered rod is inwardly pulled by the traction cable such that the two light shades are gradually folded by the elastomer for gradually decreasing the pivoting angle between the two light shades to gradually contract the illuminated area;

when the tubular arm is moved downwardly, the rack is upwardly engaged with the gearwheel and the tapered rod is outwardly pushed by the traction cable such that the two light shades are gradually unfolded by the tapered rod for gradually increasing the pivoting angle between the two light shades to gradually expand the illuminated area.

5. The adjustable luminaire as claimed in claim 4, wherein the tubular arm is inverted L-shaped.

6. The adjustable luminaire as claimed in claim 1, wherein the at least two light shades are two light shades respectively pivotally connected to the tubular arm, the light assembly having a pivot co-axially disposed in between the two light shades for pivotally connecting the two light shades, the light assembly having an elastomer mounted in between the two light shades, two ends of the elastomer connected to the two light shades respectively for tending to pull the two light shades together, the driving assembly comprising a traction cable having one end connected to the base and the other end connected to a tapered rod, the tapered rod having an enlarged end connected to the traction cable and a narrow end movably abutted against the two light shades, the traction cable and the enlarged end movably received in the tubular arm, the driving assembly having two hinge joints disposed on the tubular arm for making the tubular arm foldable, the traction cable connected to the tapered rod via the two hinge joints;

wherein when the tubular arm is folded upwardly relative to the base by the rotation of the two hinge joints, the tapered rod is inwardly pulled by the traction cable such that the two light shades are gradually folded by the elastomer for gradually decreasing the pivoting angle between the two light shades to gradually contract the illuminated area;

when the tubular arm is folded downwardly relative to the base by the rotation of the two hinge joints, the tapered rod is outwardly pushed by the traction cable such that the two light shades are gradually unfolded by the tapered rod for gradually increasing the pivoting angle between the two light shades to gradually expand the illuminated area.

7. The adjustable luminaire as claimed in claim 1, wherein the at least two light shades are two light shades respectively pivotally connected to the tubular arm, the light assembly having a pivot co-axially disposed in between the two light shades for pivotally connecting the two light shades, the light assembly having an elastomer mounted in between the two light shades, two ends of the elastomer abutted against the two light shades respectively for tending to push the two light shades aside, the driving assembly comprising a first rack disposed in the base, a first gearwheel disposed in the lower part of the tubular arm for engaging with the first rack, a second gearwheel disposed in the upper part of the tubular arm, a third gearwheel disposed in the tubular arm for engaging with the second gearwheel, a transmission belt disposed between the first gearwheel and the second gearwheel for relatively connecting the first gearwheel and the second gearwheel, and a second rack disposed on the pivot rod for engaging with the third gearwheel, the tubular arm having two limiting rods extending therefrom, the two light shades disposed in between the two limiting rods and confined by the two limiting rods;

wherein when the tubular arm is moved upwardly, the first rack is engaged with the first gearwheel for relatively driving the second gearwheel and the third gearwheel is relatively engaged with the second gearwheel for gradually upwardly moving the second rack such that the two light shades are gradually upwardly moved and folded by the confinement of the two limiting rods for gradually contracting the illuminated area;

when the tubular arm is moved downwardly, the first rack is engaged with the first gearwheel for relatively driving the second gearwheel and the third gearwheel is relatively engaged with the second gearwheel for gradually downwardly moving the second rack such that the two light shades are gradually downwardly moved and unfolded by the elastomer for gradually expanding the illuminated area.

8. The adjustable luminaire as claimed in claim 1, wherein the driving assembly comprising a traction cable received in the tubular arm, the traction cable having one end connected to the base and the other end connected to one side of each of the at least two light shades, the at least two light shades movably partially received in the tubular arm;

wherein when the tubular arm is moved upwardly, the traction cable gradually pulls up the at least two light shades such that the at least two light shades are pivotally folded and partially received in the tubular arm for gradually contracting the illuminated area;

when the tubular arm is moved downwardly, the traction cable gradually pushes down the at least two light shades such that the at least two light shades are pivotally unfolded and extended from the tubular arm for gradually expanding the illuminated area.

9. The adjustable luminaire as claimed in claim 1, wherein the tubular arm is inverted U-shaped, the end of the tubular arm connected to the base being relatively longer than the other end of the tubular arm.

* * * * *